US010407924B1

(12) United States Patent
Johnson

(10) Patent No.: US 10,407,924 B1
(45) Date of Patent: Sep. 10, 2019

(54) FLOAT SPRAYER SYSTEM

(71) Applicant: Credem H. Johnson, New London, MN (US)

(72) Inventor: Credem H. Johnson, New London, MN (US)

( * ) Notice: Subject to any disclaimer, the term of this patent is extended or adjusted under 35 U.S.C. 154(b) by 0 days.

(21) Appl. No.: 15/981,488

(22) Filed: May 16, 2018

(51) Int. Cl.

| | |
|---|---|
| ***E04F 21/24*** | (2006.01) |
| ***B05B 1/20*** | (2006.01) |
| ***E04B 5/32*** | (2006.01) |
| *E01C 19/40* | (2006.01) |
| *E01C 19/44* | (2006.01) |

(52) U.S. Cl.
CPC ..... *E04F 21/241* (2013.01); *B05B 1/205* (2013.01); *E01C 19/402* (2013.01); *E01C 19/44* (2013.01); *E04B 5/32* (2013.01); *E04B 2103/02* (2013.01)

(58) Field of Classification Search
CPC ..... B05B 12/00; B05B 9/0403; B05B 9/0426; E04F 21/16; E04F 21/161
USPC ..... 239/69, 532, 99, 101, 754, 375; 404/133.1, 114, 96, 97, 118, 111; 401/137, 139
See application file for complete search history.

(56) References Cited

U.S. PATENT DOCUMENTS 2,109,933 A * 3/1938 Sloan ..... E04F 21/248 15/49.1
2,416,635 A * 2/1947 Meyer ..... A47L 13/20 15/236.01
2,692,641 A * 10/1954 Woods ..... E01C 19/44 126/401
2,804,767 A 9/1957 Schoen
2,882,716 A 4/1959 Anderson, Sr.
3,015,837 A * 1/1962 Teall ..... B05B 9/01 118/118
3,403,960 A 10/1968 Ballard
3,981,596 A * 9/1976 Melton ..... A47L 11/03 401/48
4,331,297 A * 5/1982 Gipson ..... E04F 21/248 239/289
4,421,435 A * 12/1983 Zemke ..... E01C 19/402 404/113
4,520,527 A * 6/1985 Maggio ..... E04G 21/10 15/144.1
4,638,948 A * 1/1987 Marlek ..... B05B 9/08 222/538
4,702,641 A * 10/1987 Naser ..... E01C 19/44 15/235.8
4,887,771 A * 12/1989 Marlek ..... B05B 13/005 239/722

(Continued)

*Primary Examiner* — Chee-Chong Lee
*Assistant Examiner* — Joseph A Greenlund
(74) *Attorney, Agent, or Firm* — Neustel Law Offices

(57) ABSTRACT

A float sprayer system for efficiently dispensing a fluid from a float to treat a curing material. The float sprayer system generally includes a float for smoothing a curing material and at least one sprayer on the float; with the at least one sprayer being adapted to dispense a fluid from the float. A pump is fluidly connected to the at least one sprayer by a conduit which extends through a handle that is connected to the float. The pump is adapted to transfer the fluid from the fluid source through the conduit to be dispensed by the at least one sprayer on the float. A valve on the handle may be utilized to control flow through the conduit within the handle, and a mobile device may be utilized to control the pump.

15 Claims, 13 Drawing Sheets

(56) References Cited

U.S. PATENT DOCUMENTS 5,009,547 A * 4/1991 Clark ..... E04F 21/248 239/129
5,024,384 A * 6/1991 Redmon ..... B05B 9/0861 239/289
5,249,886 A * 10/1993 Huerta, Jr. ..... E01C 23/025 15/144.1
5,362,165 A * 11/1994 Kluga ..... E04F 21/241 15/235.4
5,366,309 A * 11/1994 Springall ..... B05C 5/02 118/108
5,393,168 A * 2/1995 Jarvis ..... E01C 19/44 15/235.8
5,540,519 A * 7/1996 Weber ..... E01C 19/402 15/235.4
5,671,889 A * 9/1997 Petty ..... B05B 7/0846 239/418
5,890,834 A * 4/1999 Waldenberger ..... E01C 19/38 404/133.05
5,984,571 A * 11/1999 Owens ..... E01C 19/402 15/235.8
6,017,163 A * 1/2000 Keppers ..... A47L 13/22 15/321
6,200,065 B1 * 3/2001 Eitzen ..... E01C 19/402 404/114
6,279,838 B1 * 8/2001 Sivells ..... A01G 25/09 239/146
6,540,423 B1 * 4/2003 Kugler ..... E04D 15/06 118/108
6,705,799 B2 * 3/2004 Piccoli ..... E01C 19/402 224/157
6,739,798 B2 * 5/2004 Vandewinckel ..... E04F 21/248 404/112
6,827,523 B2 * 12/2004 Medendorp ..... E01C 19/44 15/143.1
7,063,281 B2 * 6/2006 Schommer ..... B05B 7/0884 239/428.5
7,316,524 B1 * 1/2008 Pikuet ..... E01C 19/38 404/114
7,651,296 B2 * 1/2010 Lindley ..... E01C 19/402 404/114
7,896,266 B1 * 3/2011 Cooper ..... B05B 9/007 239/754
8,246,263 B2 * 8/2012 Bober ..... A47L 11/03 401/139
8,360,672 B2 1/2013 Stubbs
9,320,406 B2 * 4/2016 Irwin ..... A47L 13/22
9,321,062 B1 * 4/2016 Hawkins, Jr. ..... E04F 21/161
2009/0274517 A1 * 11/2009 Rose ..... E04F 21/248 404/112
2014/0029372 A1 1/2014 Roark, Jr.

* cited by examiner

FLOAT SPRAYER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a float sprayer system for efficiently dispensing a fluid from a float to treat a curing material.

Related Art

Any discussion of the related art throughout the specification should in no way be considered as an admission that such related art is widely known or forms part of common general knowledge in the field.

Curing materials such as concrete and the like are often used on ground surfaces to form roads, paths, driveways, and the like. When applying such materials, it is desirable to smooth out the surface of the materials prior to curing to minimize air bubbles or other imperfections.

When smoothing out such curing materials, it is common to use tools such as trowels or floats. Such tools allow the curing material to be smoothed out and compacted prior to curing. These tools are typically used immediately after the curing material is dispensed so that the material may be smoothed out prior to curing.

It is also common to treat curing materials with various fluids, such as evaporative retardants which reduce rapid moisture loss prior to curing of concrete. Other fluids typically used include various monomolecular films. These fluids are typically applied by a separate sprayer during smoothing, which can often necessitate a second person for the job.

SUMMARY

An example embodiment is directed to a float sprayer system. The float sprayer system includes a float for smoothing a curing material and at least one sprayer on the float; with the at least one sprayer being adapted to dispense a fluid from the float. A pump is fluidly connected to the at least one sprayer by a conduit which extends through a handle that is connected to the float. The pump is adapted to transfer the fluid from the fluid source through the conduit to be dispensed by the at least one sprayer on the float. A valve on the handle may be utilized to control flow through the conduit within the handle, and a mobile device may be utilized to control the pump.

There has thus been outlined, rather broadly, some of the embodiments of the float sprayer system in order that the detailed description thereof may be better understood, and in order that the present contribution to the art may be better appreciated. There are additional embodiments of the float sprayer system that will be described hereinafter and that will form the subject matter of the claims appended hereto. In this respect, before explaining at least one embodiment of the float sprayer system in detail, it is to be understood that the float sprayer system is not limited in its application to the details of construction or to the arrangements of the components set forth in the following description or illustrated in the drawings. The float sprayer system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
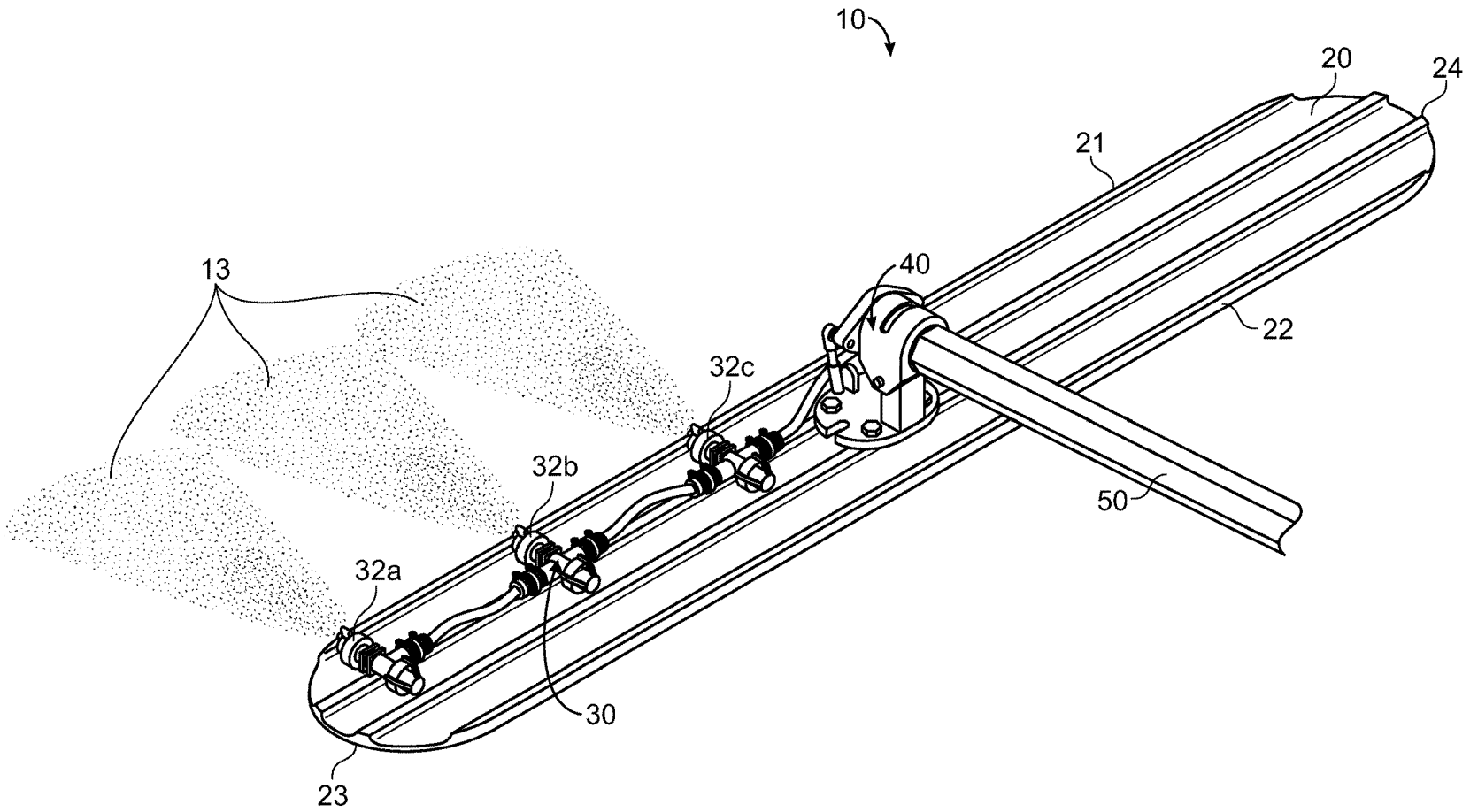
FIG. 1 is a perspective view of a float sprayer system in accordance with an example embodiment.

A. Overview.

An example float sprayer system 10 generally comprises a float 20 for smoothing a curing material 12 such as concrete. A sprayer 32 is positioned on the float 20, wherein each of the sprayers 32 is adapted to dispense a fluid 13 from the float 20. A handle 50 may be connected, such as hingedly, to the float 20. A pump 60 connected to a fluid source 65 storing the fluid 13 may be fluidly connected to the sprayer 32 by a conduit 56; with the conduit 56 being fluidly connected between the pump 60 and the sprayer 32. The conduit 56 may extend through the handle 50. The handle 50 may include a guide member 44 through which the conduit 56 enters the handle 50. The pump 60 may be adapted to transfer the fluid 13 from the fluid source 65 through the conduit 56 to be dispensed by the sprayer 32.

The conduit 56 may include a valve 54 for selectively starting or stopping flow of the fluid 13 through the conduit 56 to the sprayer 32. The valve 54 may be connected to the handle 50 such that the valve 54 may be operated from the handle 50. The pump 60 may be remotely activated or deactivated, such as by a mobile device 68 such as a remote control or phone.

The float 20 may comprise an inner end 22 facing toward the handle 50 and an outer end 21 facing away from the handle 50. The sprayer 32 may be oriented to spray outwardly from the outer end 21 of the float 20. The float 20 may comprise a first side 23 and a second side 24. The sprayer 32 may be positioned near the first side 23 of the float 20. The float 20 may comprise an upper surface 25 and a lower surface 26. The sprayer 32 may be positioned on the upper surface 25 of the float 20.

In another exemplary embodiment, an example float sprayer system 10 may comprise a float 20 for smoothing a curing material 12 and a plurality of sprayers 32 on the float 20; with each of the sprayers 32 being adapted to spray a fluid 13 from the float 20. A handle 50 may be connected to the float 20; with a conduit 56 fluidly connected between a pump 60 which is connected to a fluid source 65 and the sprayers 32 extending through the handle 50, such as through a passage 53 in the handle 50. The pump 60 may be adapted to transfer a fluid 13 from the fluid source 65 through the conduit 56 to be sprayed by the sprayers 32.

The sprayers 32 may be linearly oriented across the float 20 and in some embodiments may be positioned near a first side 23 of the float 20. The sprayers 32 may be adapted to spray the fluid 13 outwardly from the outer end 21 of the float 20, or downwardly from the lower surface 26 of the float 20. The conduit 56 may include a valve 54 for selectively starting or stopping flow of the fluid 13 through the conduit 56 to the sprayers 32. The valve 54 may be connected to and accessible from the handle 50. A mobile device 68 such as a remote control may be utilized to activate or deactivate the pump 60.

Yet another exemplary embodiment of the float sprayer system 10 may comprise a float 20 for smoothing a curing concrete 12, wherein the float 20 comprises an upper surface 25, a lower surface 26, an outer end 21, an inner end 22, a first side 23, and a second side 24. A handle 50 may be hingedly connected to a central point along a width of the float 20, wherein the float 20 comprises a first portion 27 on a first side 23 of the handle 50 and a second portion 28 on a second side 24 of the handle 50. A plurality of sprayers 32 may be positioned on the upper surface 25 of the float 20; with each of the sprayers 32 being adapted to spray a fluid 13 outwardly from the outer end 21 of the float 20. Each of the sprayers 32 may be positioned on the first portion 27 of the float 20.

A pump 60 may be connected to a fluid source 65; with a conduit 56 being fluidly connected between the pump 60 and the sprayers 32. The conduit 56 may extend through the handle 50; with the pump 60 being adapted to transfer a fluid 13 from the fluid source 65 through the conduit 56 to be sprayed by the sprayers 32. A mobile device 68 may selectively activate or deactivate the pump 60. A valve 54 on the handle 50 may selectively start or stop flow of the fluid 13 through the conduit 56 to the sprayers 32.

B. Float.

As shown throughout the figures, the float sprayer system 10 may include a float 20 which is adapted to smooth out and compact a curing material 12 such as concrete. The float 20 may comprise various shapes, sizes, and configurations depending on the application it is being used for. The shape, size, and configuration of the exemplary float 20 shown in the figures should thus not be construed as limiting.

Figure 2:
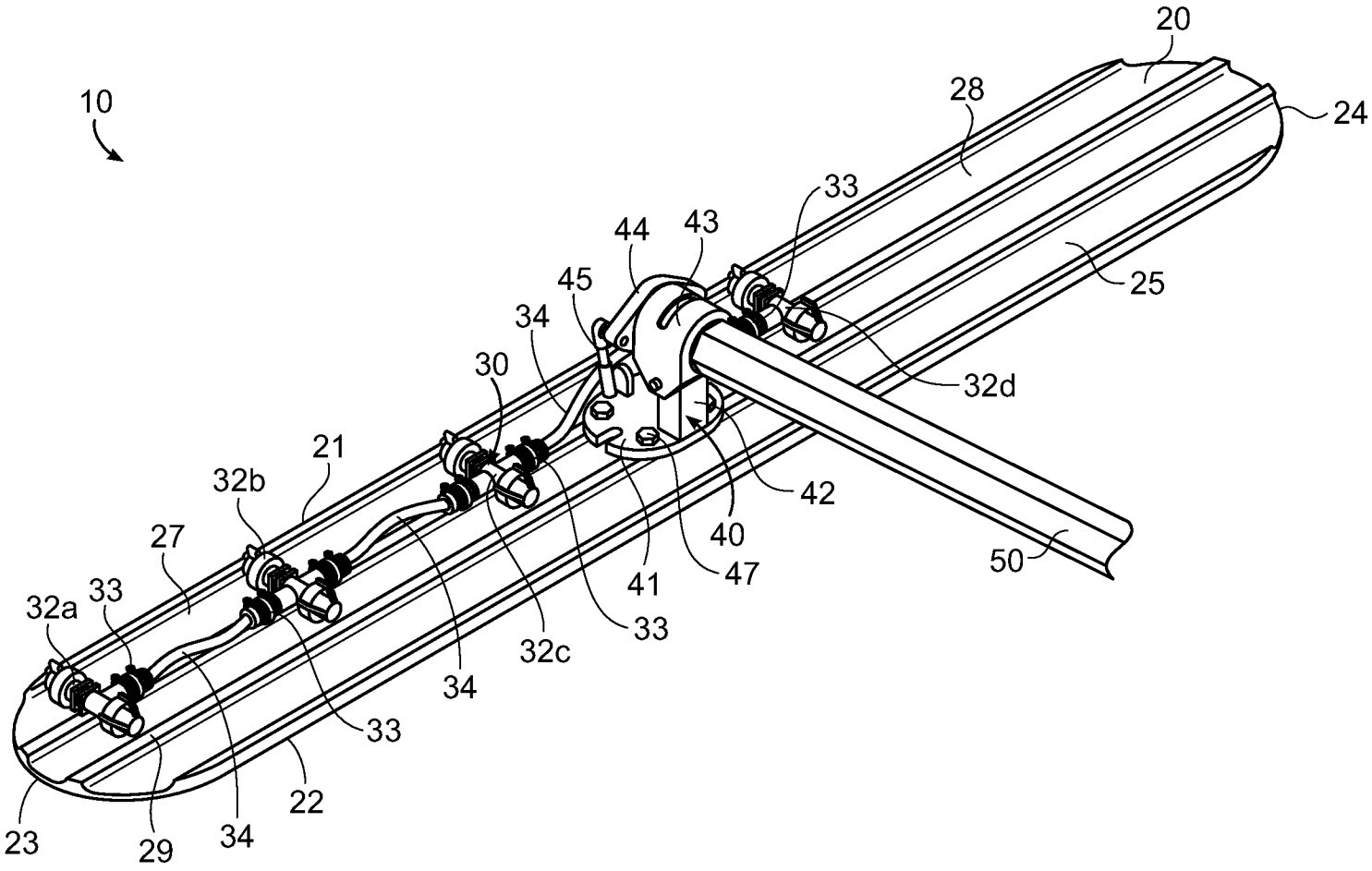
FIG. 2 is a perspective view of a float sprayer system in accordance with an example embodiment.
Figure 6A:
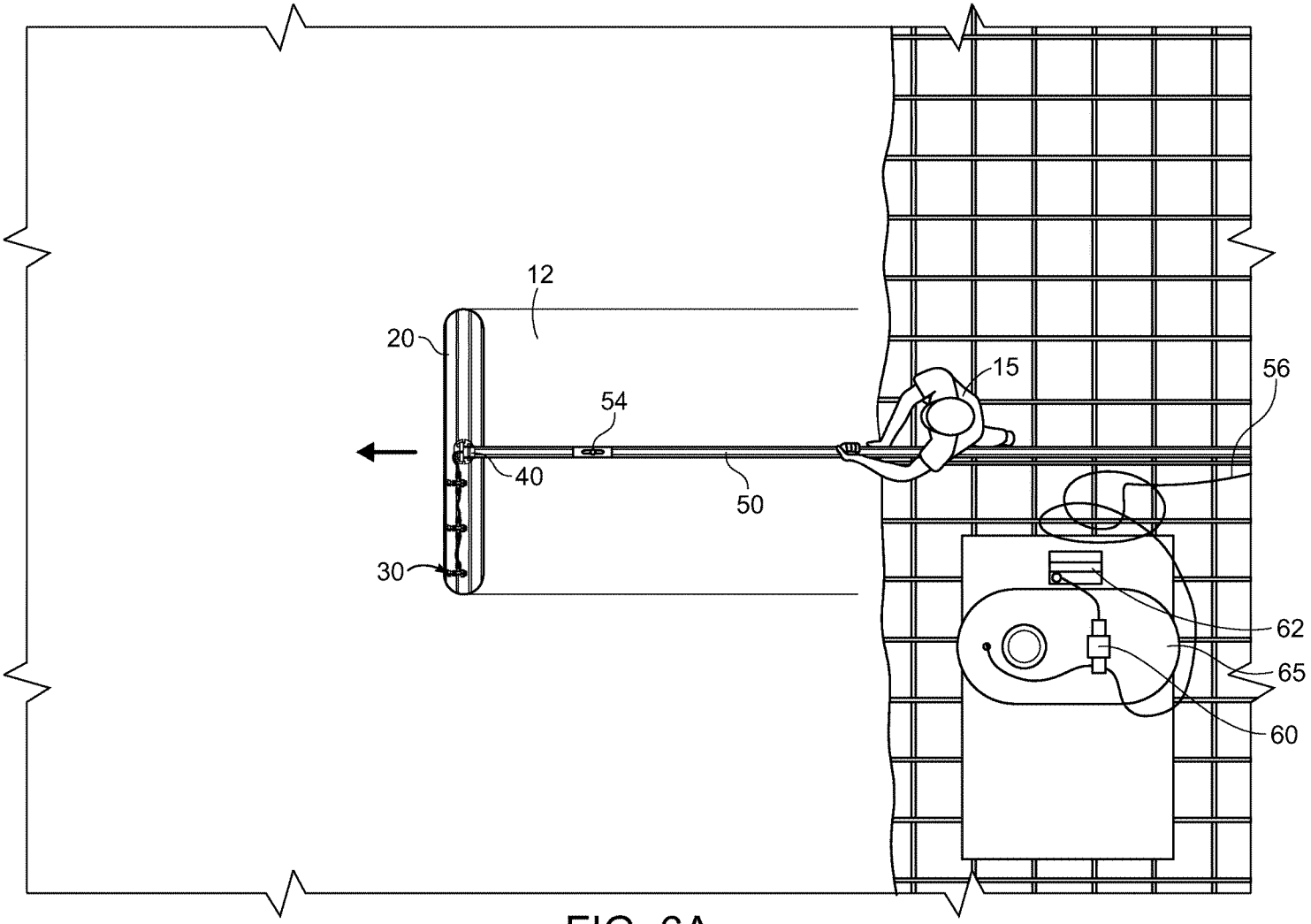
FIG. 6A is a top view of an operator performing a first forward stroke with a float sprayer system in accordance with an example embodiment.

As best shown in FIGS. 1-2, the float 20 may comprise an outer end 21, an inner end 22, a first side 23, a second side 24, an upper surface 25, and a lower surface 26. The outer end 21 of the float 20 faces away from the operator 15 when in use such as shown in FIG. 6A. The inner end 22 of the float 20 faces toward the operator 15 when in use as similarly shown in FIG. 6A.

The first and second sides 23, 24 define the outer bounds of the float 20. The float 20 may comprise a first portion 27 between a midpoint along its width and the first side 23 of the float. The float 20 may also comprise a second portion 28 between a midpoint along its width and the second side 24 of the float 20, such as shown in FIG. 2. The distance between the first and second sides 23, 24 (the width) of the float 20 may vary for different applications.

Figure 3:
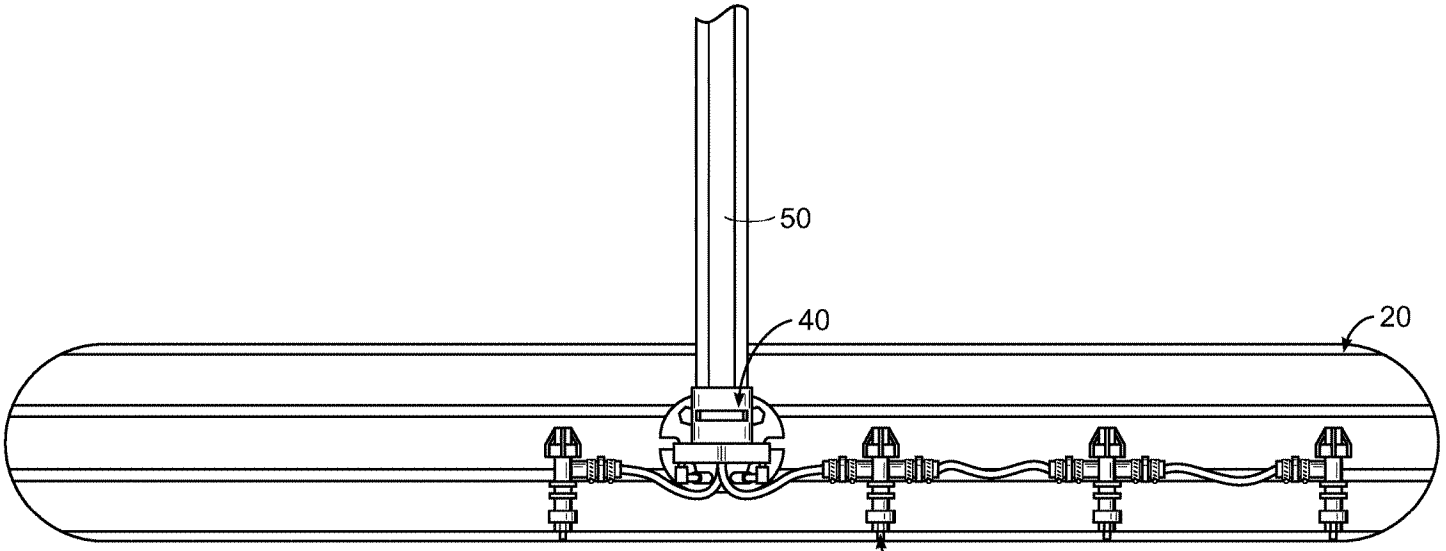
FIG. 3 is a top view of a float sprayer system in accordance with an example embodiment.
Figure 4:
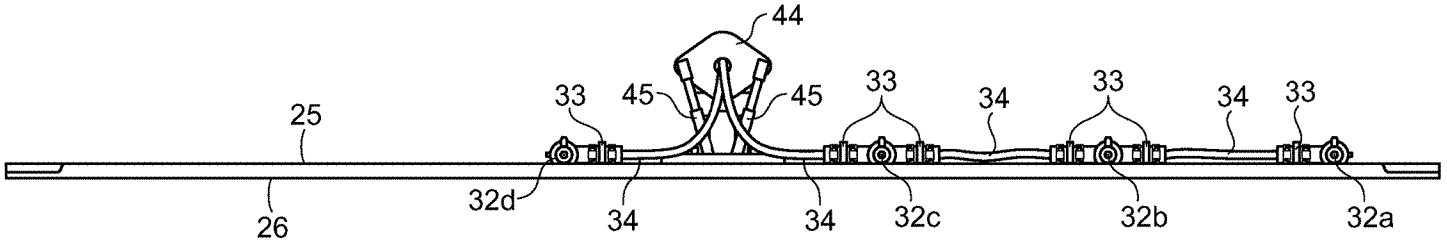
FIG. 4 is a frontal (outer) view of a float sprayer system in accordance with an example embodiment.
Figure 5:
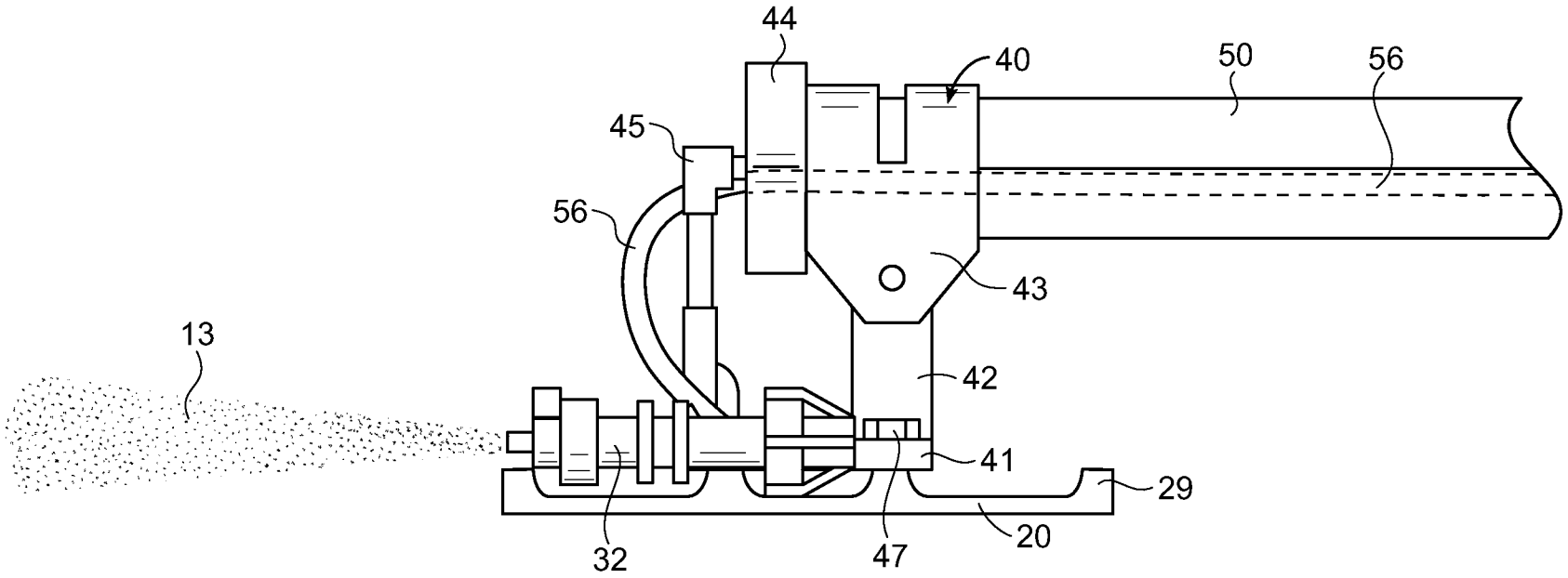
FIG. 5 is a side view of a sprayer assembly of a float sprayer system in accordance with an example embodiment.

The upper surface 22 of the float 20 is exposed when the float 20 is in use. One or more sprayers 32 may be connected to the upper surface 22 of the float 20 in some embodiments such as shown in FIG. 2. The upper surface 22 of the float 20 may include ribs 29 which extend between the respective sides of the float 20 such as shown in FIG. 2. The handle 50 may also be connected to the upper surface 22 of the float 20, such as via a connector 40, as shown in FIGS. 2-4.

The lower surface 23 of the float 20 is used to smooth out and compact the curing material 12. In some embodiments, the lower surface 23 of the float 20 will be smooth-faced so as to leave smoothed-out concrete with no discernible lines or the like. In other embodiments, the lower surface 23 of the float 20 may include ribs or other projections or indentations which leave a pattern when run across a curing material 12 such as concrete.

C. Sprayers.

As shown in FIGS. 1-5, a sprayer assembly 30 may be connected to the float 20. Although the exemplary figures each illustrate the sprayer assembly 30 being connected to the upper surface 25 of the float 20, it should be appreciated that other configurations could be utilized. For example, the sprayer assembly 30 could be positioned on the outer end 21 of the float 20, on the inner end 22 of the float 20, on the lower surface 26 of the float 20, or combinations thereof. As best shown in FIGS. 1-4, the sprayer assembly 30 may comprise one or more sprayers 32 which are interconnected to a pump 60 by a conduit 56 and to each other by couplers 33 and conduits 34. The number of sprayers 32 in the sprayer assembly 30 may vary in different embodiments. FIG. 1 illustrates an exemplary embodiment including three sprayers 32: a first sprayer 32*a*, a second sprayer 32*b*, and a third sprayer 32*c*. FIG. 2 illustrates another exemplary embodiment including four sprayers 32: a first sprayer 32*a*, a second sprayer 32*b*, a third sprayer 32*c*, and a fourth sprayer 32*d*.

The type of sprayer 32 utilized may vary in different embodiments. In the exemplary embodiments shown, the sprayers 32 comprise devices adapted to spray and disperse a fluid 13 outwardly from the float 20. In other embodiments, the sprayers 32 may be adapted to dispense the fluid 13 in other manners, such as by a stream rather than a spray.

The number of sprayers 32 may vary in different embodiments. Smaller floats 20 may require less sprayers 32, while larger floats 20 may require more sprayers 32. The exemplary embodiments shown in the figures illustrate the usage of three (FIG. 1) or four (FIG. 2) sprayers 32. In some embodiments, a single sprayer 32 could be utilized.

The area which the sprayers 32 dispense the fluid 13 may vary in different embodiments. In the exemplary embodiment shown in FIG. 1, the fluid 13 is shown as being dispensed outwardly from the outer end 21 of the float 20. In alternate embodiments, the fluid 13 could be dispensed in the opposite direction; e.g., from the inner end 22 rather than the outer end 21. In other embodiments, the fluid 13 could be dispensed from the sides 23, 24 of the float 20. In other embodiments, the fluid 13 could be dispensed from the lower surface 26 of the float 20.

As shown in the figures, it may be preferable to dispense fluid 13 from only a portion of the width of the float 20. This can be useful for staggering outward and inward strokes of the float 20 as discussed in more detail below. For example, the sprayers 32 may only be positioned on a first portion 27 of the float 20 such as shown in FIG. 1, with the second portion 28 of the float 20 not including any sprayers 32. By connecting the sprayers 32 to only one portion 27 of the float 20, such as the first half of the width of the float 20, the staggered distribution discussed below and shown in FIGS. 6A-6E may be effectuated to more efficiently cover the area to be treated by the float 20.

Figure 9:
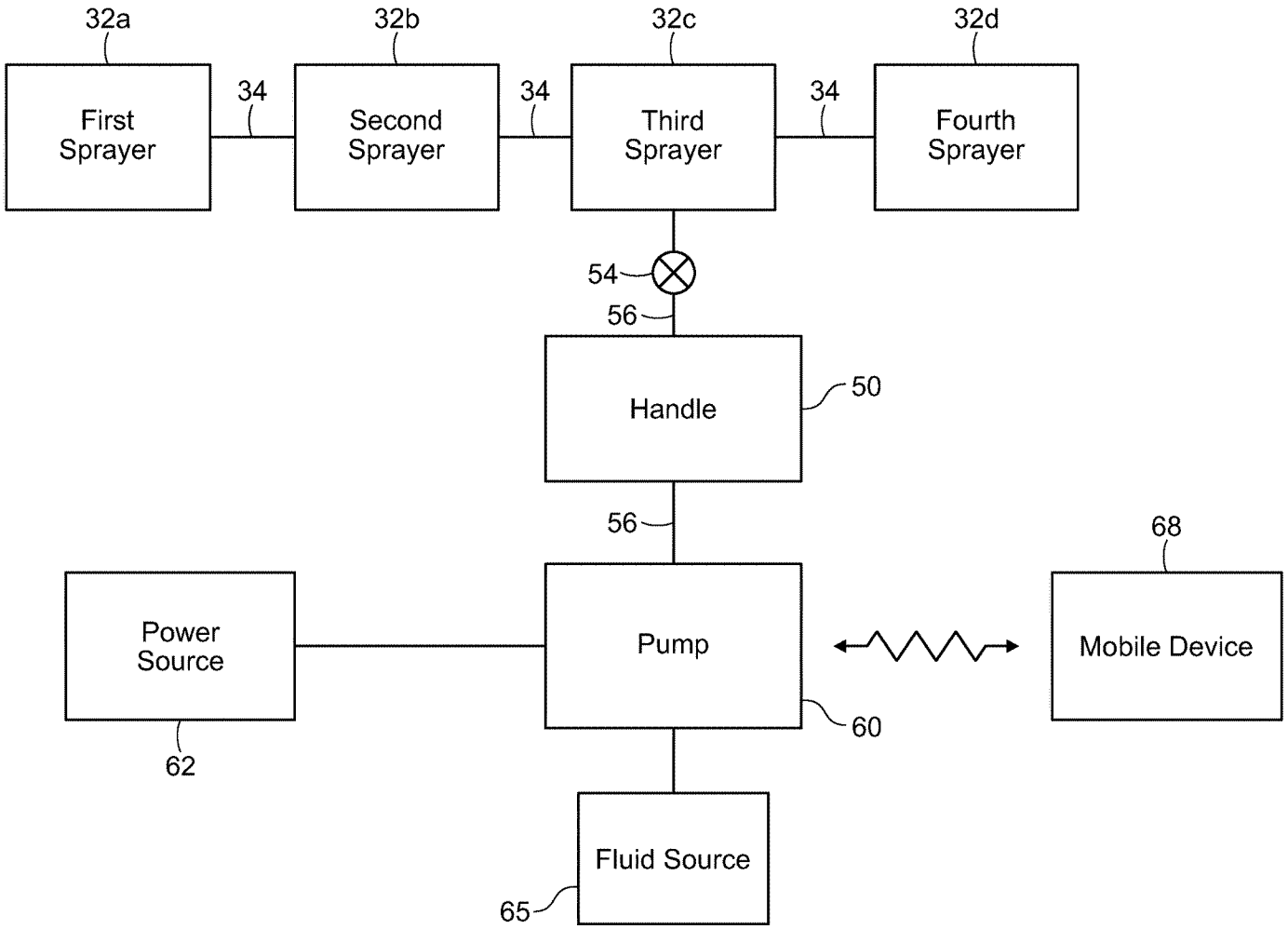
FIG. 9 is a block diagram of a float sprayer system in accordance with an example embodiment.

The sprayers 32 may be fluidly connected to a pump 60 by a conduit 56 extending through the handle 50 of the float 20 as discussed in more detail below. A single pump 60 may feed all of the sprayers 32 in embodiments in which multiple sprayers 32 are utilized, such as shown in FIG. 9. The sprayers 32 may be fluidly connected with each other by couplers 32 and conduits 34 such as shown in FIG. 2.

The couplers 32 may be utilized to couple each of the sprayers 32 with the conduits 32 which fluidly connect with the other sprayers 32. In this manner, a single flow of fluid 13 from the pump 60 and the handle conduit 56 may be utilized to feed a plurality of sprayers 32. FIG. 1 illustrates an exemplary embodiment in which a first sprayer 32*a* is connected to a first conduit 34 by a first coupler 33. The first conduit 34 is in turn connected to the second sprayer 32*b* by a second coupler 33. A third coupler 32 on the other side of the second sprayer 32*b* is connected to a second conduit 34, which is connected by a fourth coupler 33 to the third sprayer 32*c*, and so on. In this manner, the sprayers 32 may act as a manifold splitting the flow of fluid 13 from the pump 60.

D. Handle and Connector.

As shown throughout the figures, the float 20 may include a handle 50 which is grasped to manipulate the float 20, such as by pushing the float 20 forward or pulling the float 20 backward. The shape, size, and configuration of the handle 50 will vary in different embodiments and should not be construed as limited by the exemplary embodiment of the figures. The handle 50 could be short for one-handed operation of smaller floats 20 in some embodiments, or may be configured for two-handed operation of larger floats 20 such as shown in FIGS. 6A-6E.

The handle 50 is generally connected to the float 20 by a connector 40. As shown in FIGS. 1-5, the handle 50 may be hingedly or pivotably connected to the float 20 in some embodiments. The location on the float 20 to which the handle 50 is connected by vary in different embodiments. The exemplary figures illustrate the handle 50 being connected to a mid-point on the upper surface 25 of the float 20 between its first and second sides 23, 24. Various other locations may be utilized for different types of floats 20 or to suit different applications. As best shown in FIG. 3, the connector 40 may comprise a base 41 which is connected to the float 20 by fasteners 47. A base support 42 may extend upwardly from the base 41. A hinge 43 may be connected between the handle 50 and the float 20, such as the hinge 43 shown connected to the base support 42 in FIG. 2.

A guide member 44 may be positioned adjacent to the hinge 43 to inhibit full movement of the handle 50 with respect to the float 20. The hinge 43 will press against the guide member 45 when the handle 50 is rotated upwardly to a certain point, which will allow the float 20 to be pushed easily. Thus, the handle 50 may only be angularly-adjustable along a limited path in some embodiments. For example, the handle 50 may be angularly-adjustable along a window of approximately thirty degrees in some embodiments.

The guide member 44 may be connected to the base 41 by guide member supports 45 such as shown in FIG. 4. In other embodiments, the guide member 44 may itself extend upwardly from the base 41. The guide member 44 will generally include an opening through which the conduit 56 from the sprayers 32 may enter the handle 50. The guide member 44 may thus act as a guide for the conduit 56 entering the handle 50 in addition to acting as a stopper for the hinge 43.

Figure 7:
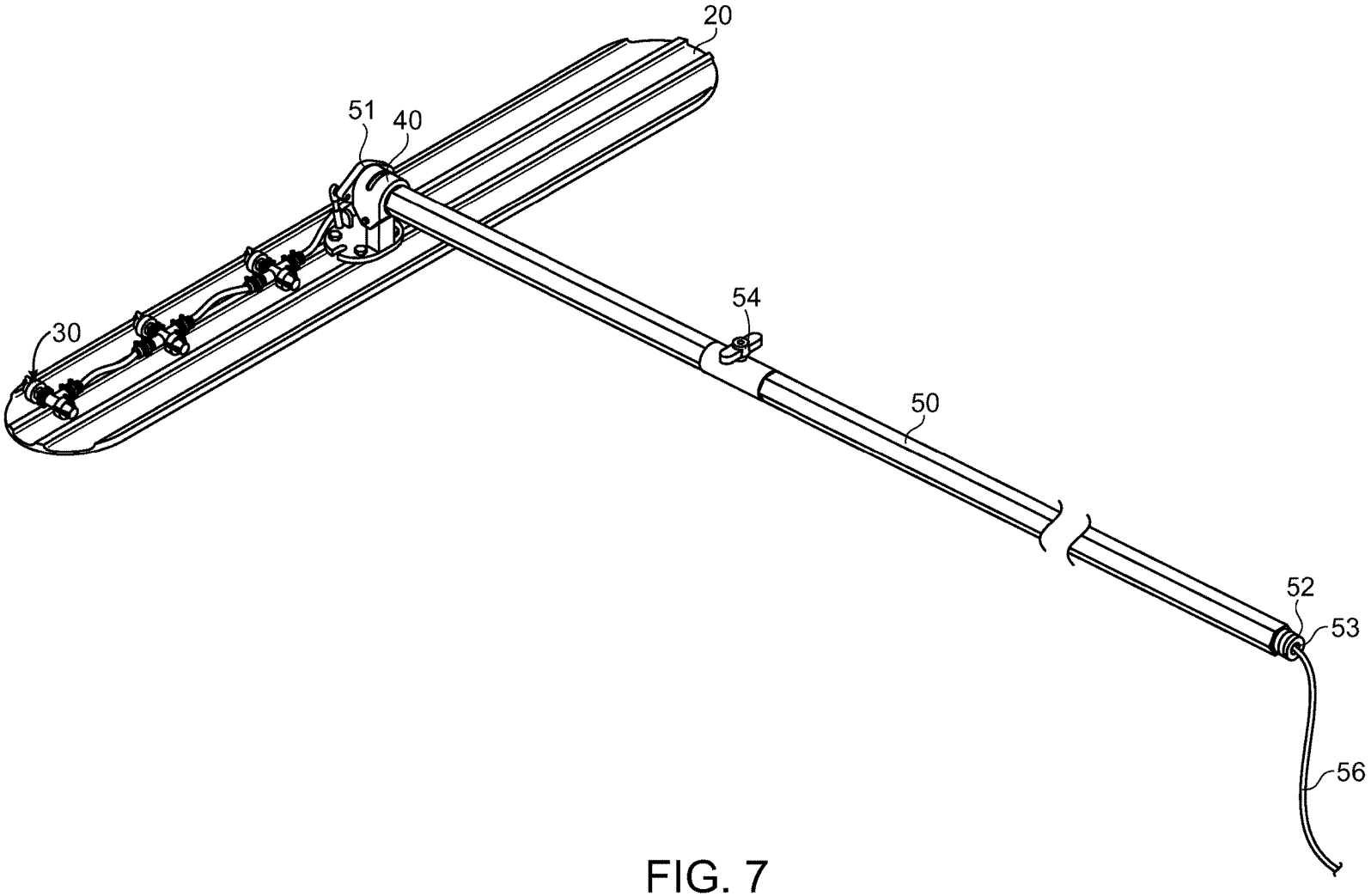
FIG. 7 is a perspective view of a float sprayer system in accordance with an example embodiment.

As shown in FIG. 7, the handle 50 may comprise a first end 51 and a second end 52. The first end 51 of the handle 50 may be connected to the float 20. In the exemplary embodiments shown in the figures, the first end 51 of the handle 50 is hingedly connected to the float 20 by a connector 40. The second end 52 of the handle 50 will generally include a distal opening through which the conduit 56 may enter the handle 50. The handle 50 may include a passage 53 extending between its first and second ends 51, 52 through which the conduit 56 may extend.

Figure 8:
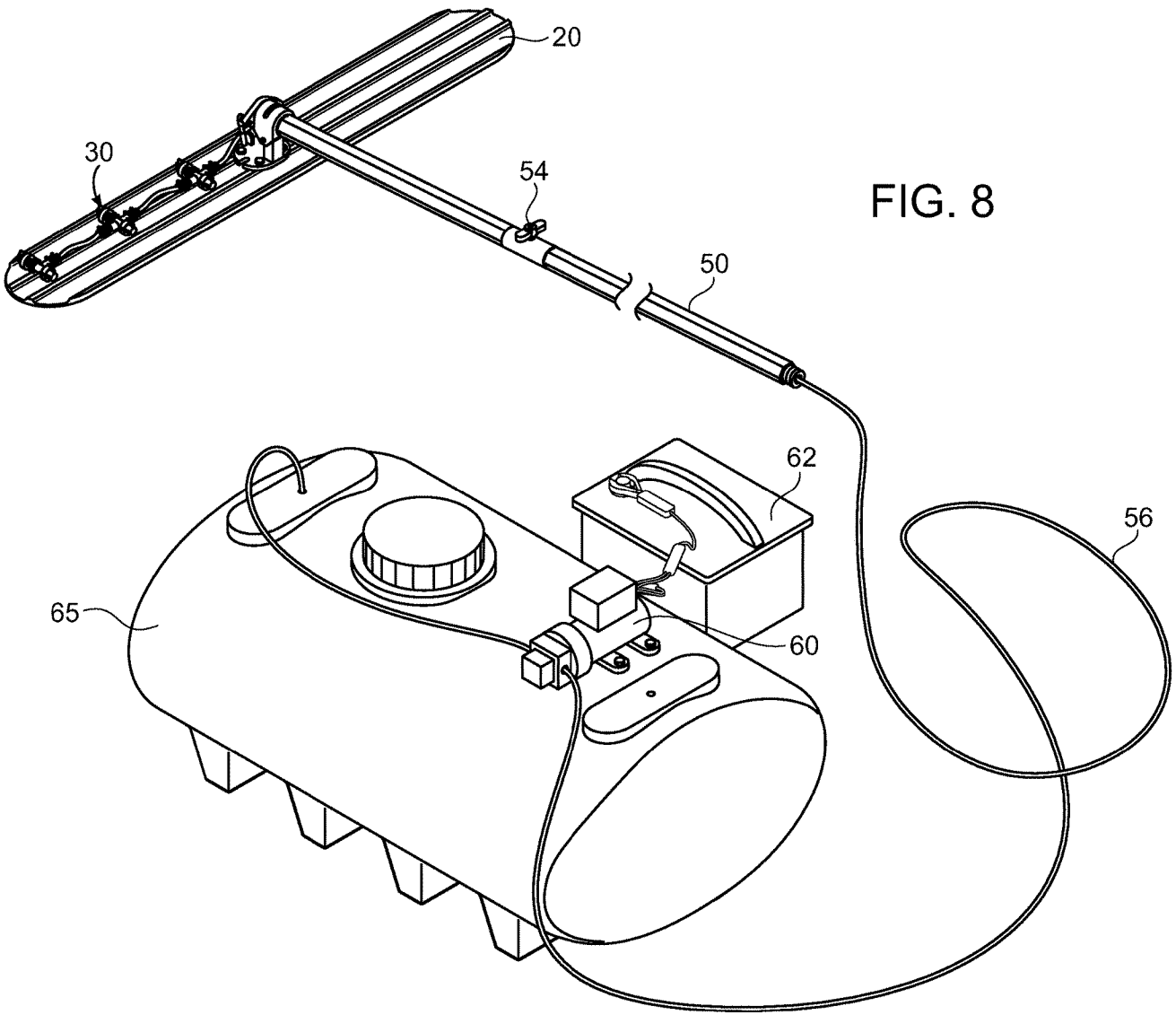
FIG. 8 is a perspective view of a float sprayer system in accordance with an example embodiment.

The conduit 56 serves to fluidly connect the pump 60 with the sprayer assembly 30. As shown in FIG. 8, the conduit 56 may enter the handle 50 through its second end 52. The conduit 56 traverses through the passage 53 of the handle 53 and exits the handle 50 at its first end 51. The conduit 56 may then extend through the guide member 44 (if used) and be routed to feed the sprayers 32 such as shown in FIG. 9. Although the figures illustrate the conduit 56 being used in combination with couplers 33 and other conduits 34 to interconnect the sprayers 32, it should be appreciated that a single conduit 56 could be utilized to feed the sprayers 32 in some embodiments.

The conduit 56 may include a valve 54 which is used to selectively start or stop flow of the fluid 13 through the conduit 56 without manipulating the pump 60 itself. The valve 54 may be positioned at various locations along the length of the conduit 56 and should not be construed as limited by the exemplary positioning shown in the figures. The valve 54 may be connected to the handle 50 such that the valve 54 may be accessed by the operator 15 grasping the handle 50 such as shown in FIG. 7.

E. Pump.

As shown in FIGS. 8-9, a pump 60 may be utilized to pump the fluid 13 through the conduit 56 to the sprayers 32. Various types of fluids 13 may be utilized, including water, evaporative retardants, monomolecular films, sealants, treatments, and the like. The scope of the present invention should not be construed as limited to any particular fluid 13, or any particular type of curing material 12.

Various types of pumps 60 may be utilized. The figures illustrate a battery-powered pump 60, though gas pumps 60 may be utilized (or any other type of pump 60). In the exemplary figures, the pump 60 is connected to a separate power source 62 (battery in the shown embodiment). In certain embodiments, the pump 60 may include its own power source 62 (such as a combustion engine).

As shown in FIGS. 8-9, the pump 60 may be connected to a fluid source 65 which stores the fluids 13 to be dispensed by the sprayers 32. The fluid source 65 may comprise a container, a reservoir, a vehicle, or any other device capable of storing the fluid 13. The fluid source 13 may in some cases be integrated with the pump 60.

The pump 60 may be remotely operable, such as by a mobile device 68 as shown in FIG. 9. Thus, the pump 60 may be remotely activated or deactivated by the operator 15 in some embodiments, such as by using a smart phone or remote control.

F. Operation of Preferred Embodiment.

In use, the pump 60 may be activated either by hand or via a mobile device 68 such as a remote control or phone. The valve 54 may start in the closed position to ensure that the sprayer assembly 30 does not activate until the proper time. Upon opening the valve 54, fluids 13 will be pumped by the pump 60 from the fluid source 65 through the conduit 56 extending through the handle 50. The fluids 13 will be fed by the conduit 56 directly to the sprayer assembly 30. The one or more sprayers 32 of the sprayer assembly 30 may then disperse the fluids 13, such as by spraying.

The fluid source 65 may be filled with the fluid 13 to be dispensed by the sprayer assembly 30. If not already connected, the conduit 56 from the handle 50 may be connected to the pump 60. The curing material 12 such as concrete may be applied to the ground surface in any manner.

FIGS. 6A-6E illustrate an exemplary method of use of an exemplary embodiment of the float sprayer system 10. It should be appreciated that the method described is merely exemplary and should not be construed as limiting on the scope. The manner in which the float 20 is utilized may vary for different applications. Further, the timing of the sprayers 32 being activated or deactivated may vary. Although the exemplary description and referenced figures below discuss alternating sprayer 32 activation on different passes, the sprayers 32 could be activated for all passes in some embodiments.

With the curing material 12 dispensed on the ground surface, the float 20 may be utilized. The handle 50 may be grasped by the operator 15 and the float 20 lowered to contact the curing material 12. The float 20 may be pushed outwardly to smooth and compact the curing material 12 to smooth out a first swathe of the curing material 12 without the sprayers 32 activated such as shown in FIG. 6A.

Figure 6B:
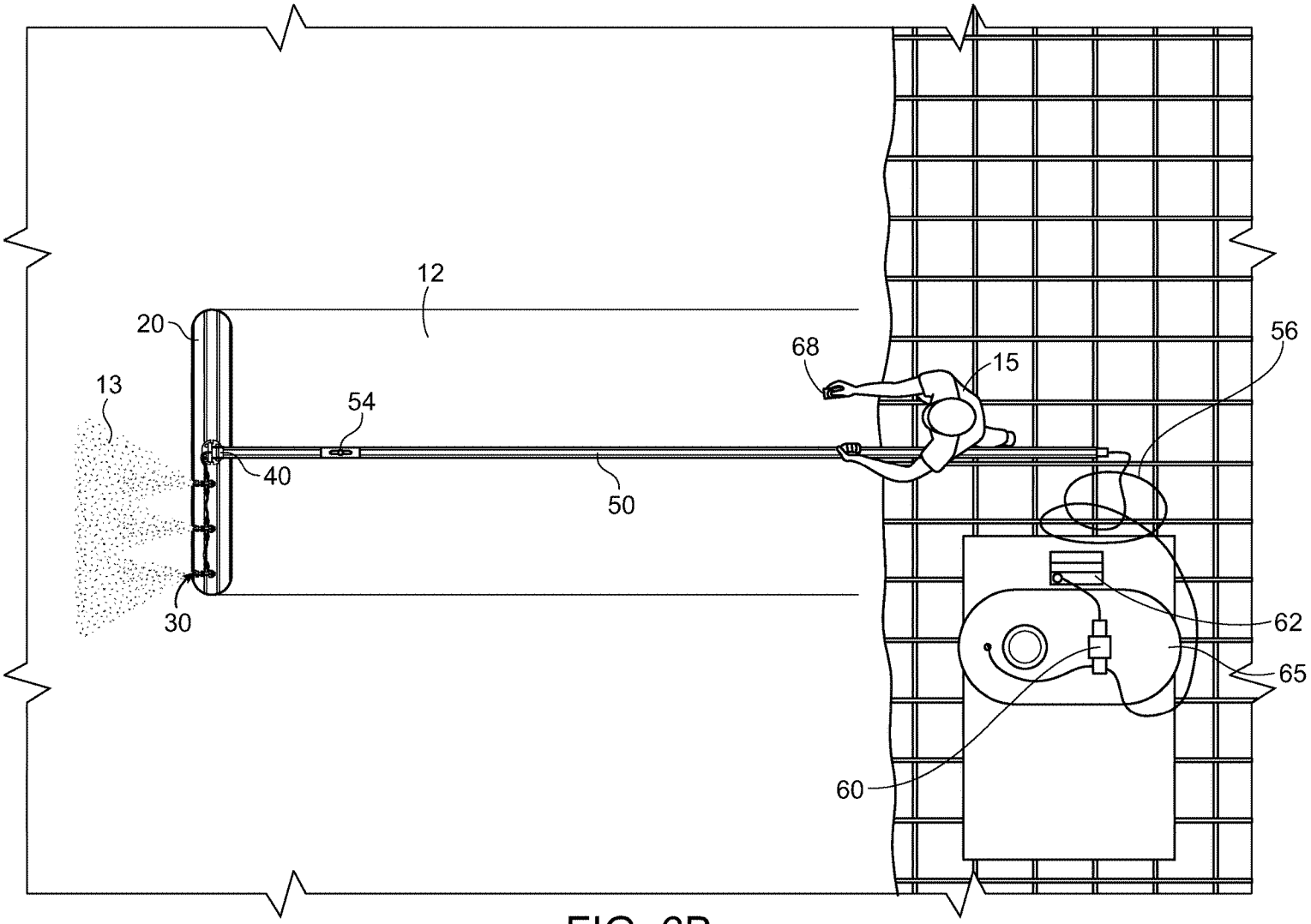
FIG. 6B is a top view of an operator performing a first forward stroke with a float sprayer system in accordance with an example embodiment.
Figure 6C:
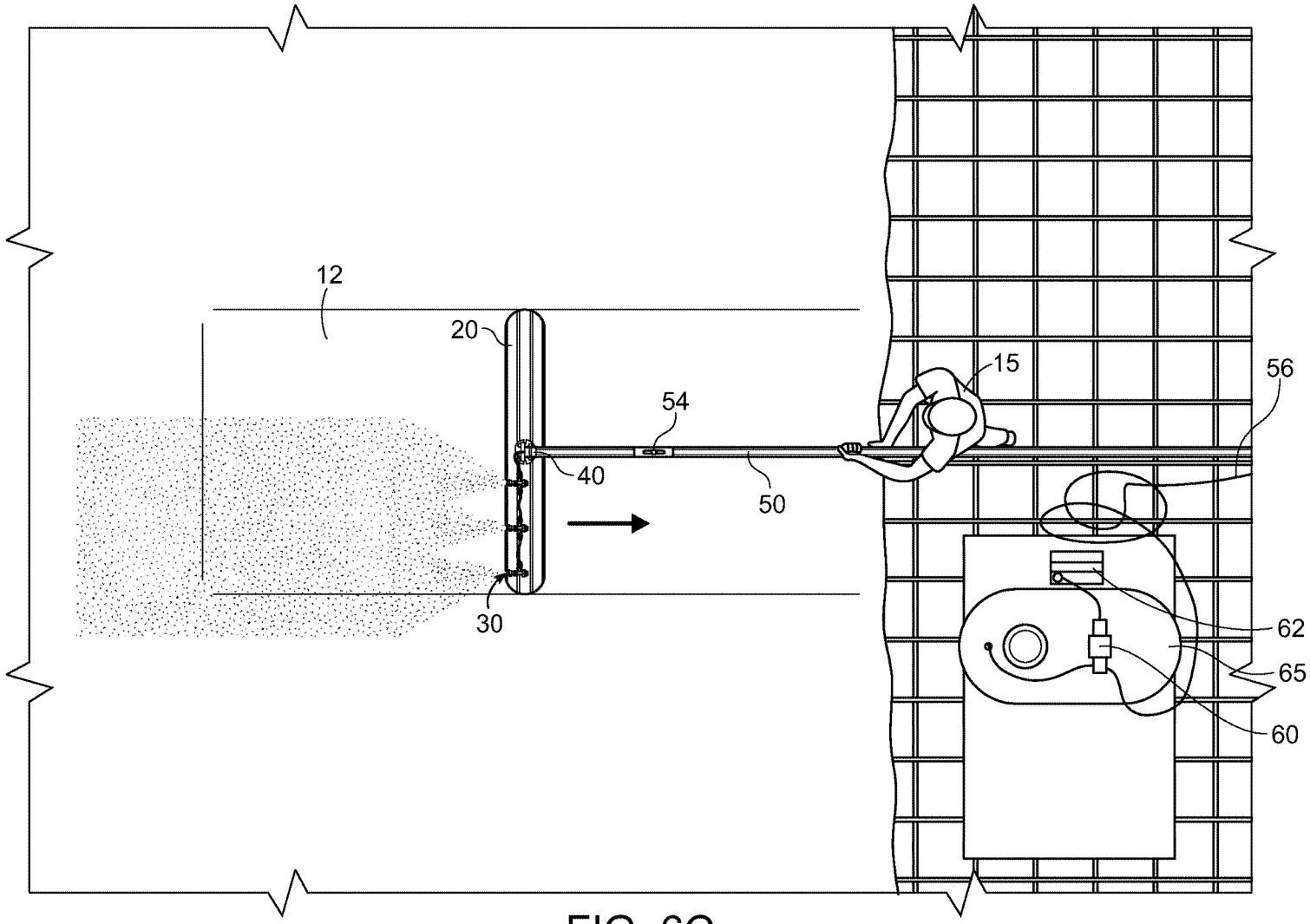
FIG. 6C is a top view of an operator performing a first backward stroke with a float sprayer system in accordance with an example embodiment.

The sprayers 32 may be activated upon the return trip on the first swathe. If the pump 60 has not already been activated, it may be powered on at this point, such as by a mobile device 68 such as a remote control. If the valve 54 was previously closed, it may then be opened to allow flow of fluids 13 from the fluid source 65 through the handle 50 to the sprayers 32. As the sprayers 32 dispense the fluids 13, the float 20 may be pulled inwardly by the operator 15 so as to apply the fluids 13 to a first half of the first swathe such as shown in FIGS. 6B and 6C.

Figure 6D:
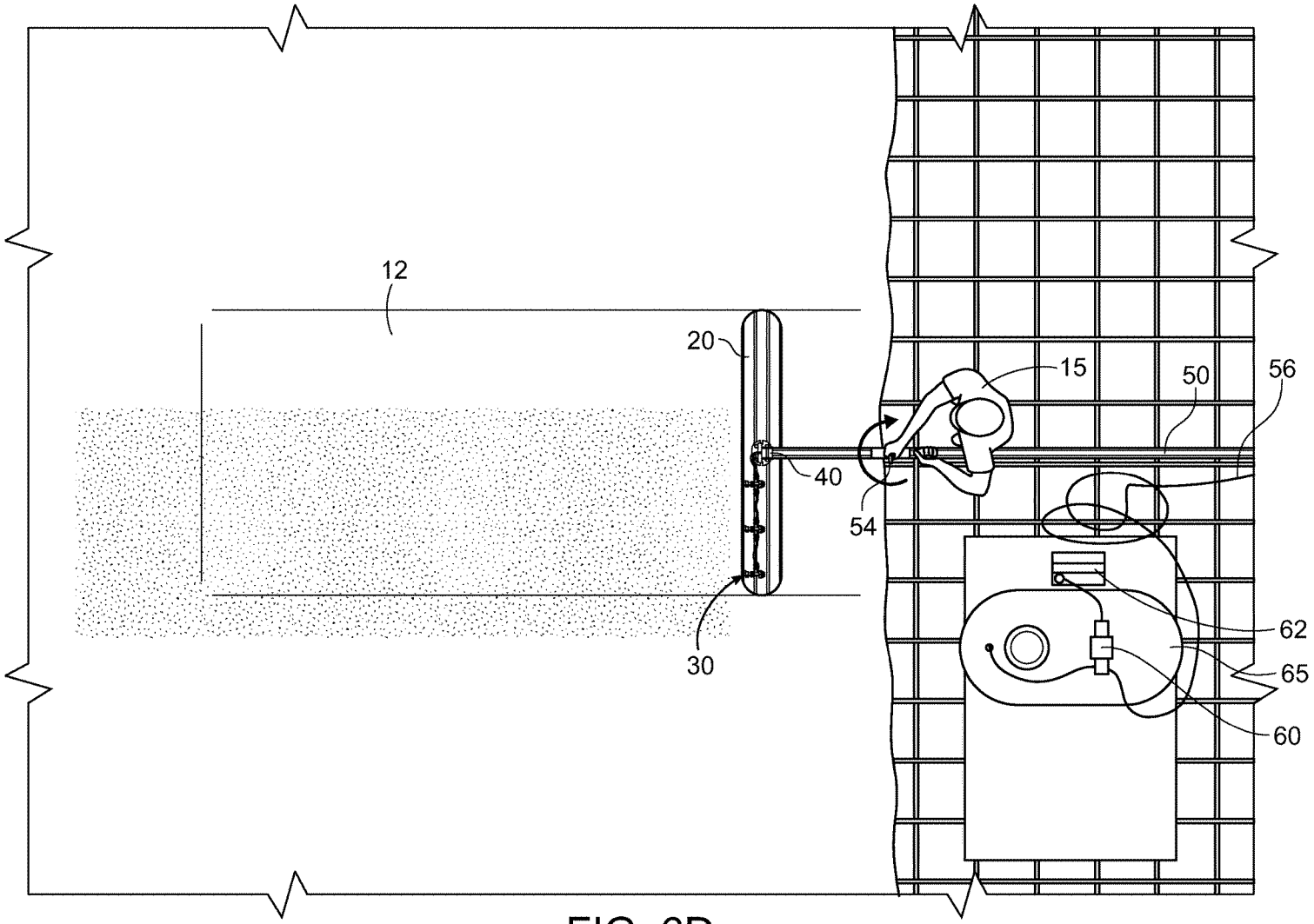
FIG. 6D is a top view of an operator performing a first backward stroke and closing a valve with a float sprayer system in accordance with an example embodiment.
Figure 6E:
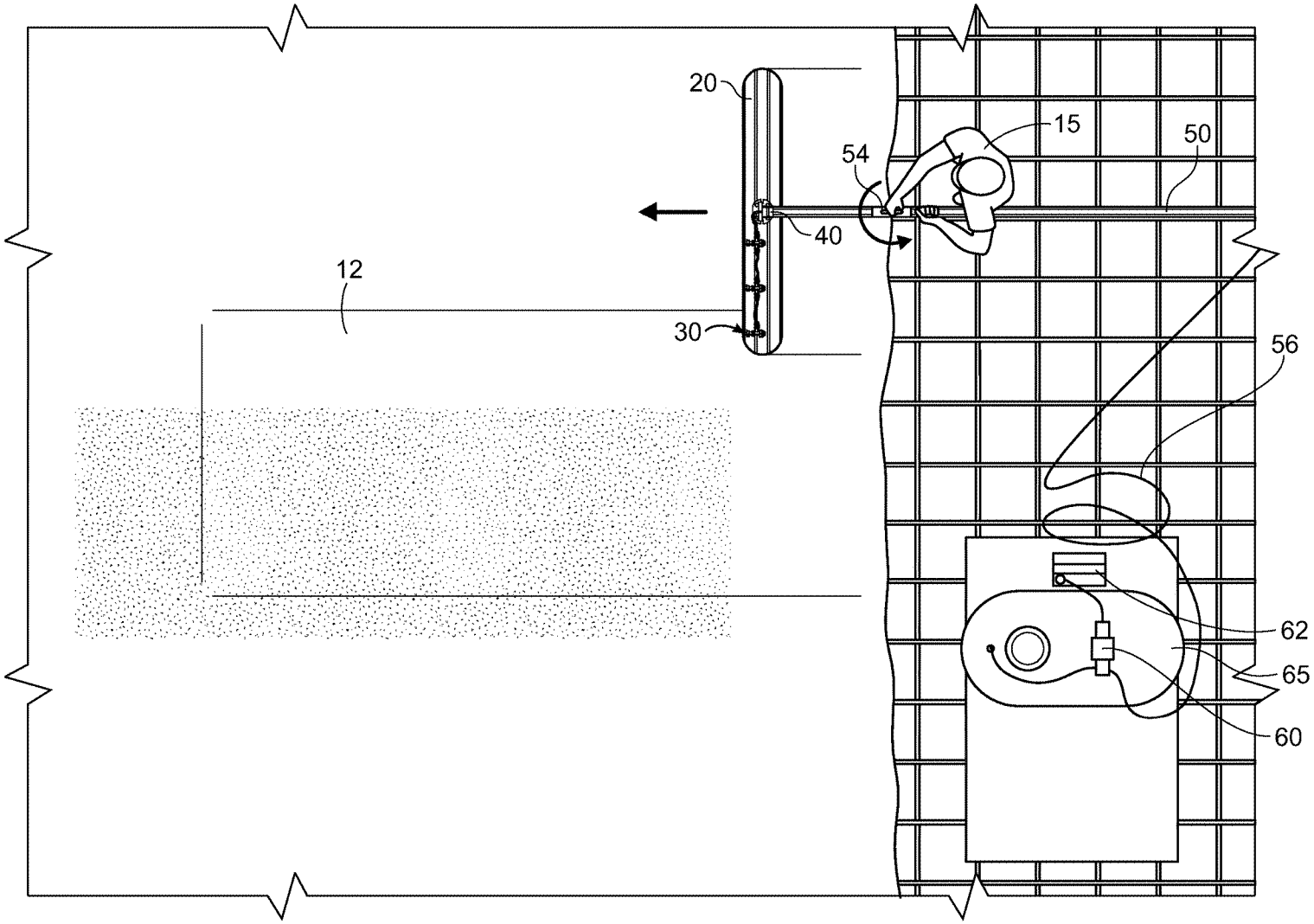
FIG. 6E is a top view of an operator performing a second forward stroke with a float sprayer system in accordance with an example embodiment.

As shown in FIG. 6D, the float 20 is pulled back toward its original starting position at the start of the first swathe. The valve 54 may then be turned on the handle 50 to stop flow of the fluids 13 to the sprayers 32 such as shown in FIG. 6D. The float 20 may then be moved to cover a second swathe and pushed outwardly such as shown in FIG. 6E with the sprayers 32 still off.

Figure 6F:
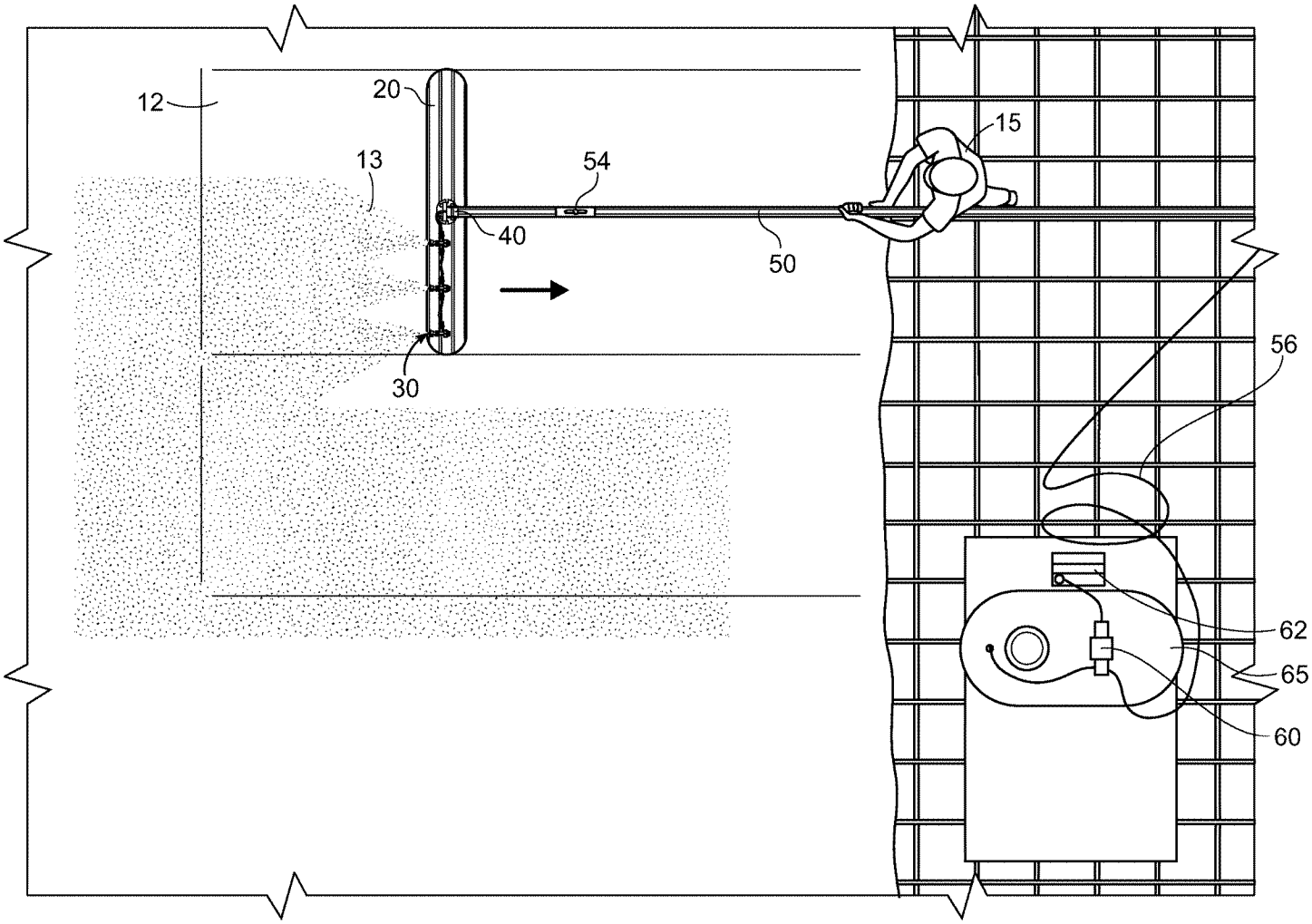
FIG. 6F is a top view of an operator performing a second backward stroke with a float sprayer system in accordance with an example embodiment.

At the end of the pass on the second swathe, the sprayers 32 may be reactivated such as by opening the valve 54. The float 20 may then be pulled inwardly as the sprayers 32 apply the fluids to the second half of the first swathe and the first half of the second swathe such as shown in FIG. 6F. In this manner, the sprayers 32 overspray to the finished side and do not spray on the overlapped portion of the subsequent pass. This manner of use increases efficiency so that fluids 13 are not wasted by over spraying on multiple passes.

Unless otherwise defined, all technical and scientific terms used herein have the same meaning as commonly understood by one of ordinary skill in the art to which this invention belongs. Although methods and materials similar to or equivalent to those described herein can be used in the practice or testing of the float sprayer system, suitable methods and materials are described above. All publications, patent applications, patents, and other references mentioned herein are incorporated by reference in their entirety to the extent allowed by applicable law and regulations. The float sprayer system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A concrete float sprayer system, comprising:

a float for smoothing a curing material, the curing material comprising concrete;

a sprayer on the float, wherein the sprayer is adapted to dispense a fluid from the float to treat the curing material;

a handle connected to the float;

wherein the float comprises an inner end facing toward the handle and an outer end facing away from the handle, wherein the sprayer is oriented to spray outwardly from the outer end of the float, wherein the float comprises a right side and a left side, wherein the right side is separated from the left side by the handle, wherein the sprayer is positioned only on the right side or the left side of the float;

a pump connected to a fluid source; and a conduit fluidly connected between the pump and the sprayer, wherein the conduit extends through the handle, wherein the pump is adapted to transfer the fluid from the fluid source through the conduit to be dispensed by the sprayer.

2. The concrete float sprayer system of claim 1, wherein the conduit includes a valve for selectively starting or stopping flow of the fluid through the conduit to the sprayer.

3. The concrete float sprayer system of claim 2, wherein the valve is connected to the handle.

4. The concrete float sprayer system of claim 1, further comprising a mobile device for activating or deactivating the pump.

5. The concrete float sprayer system of claim 1, wherein the float comprise an upper surface and a lower surface, wherein the sprayer is positioned on the upper surface of the float.

6. The concrete float sprayer system of claim 1, comprising a guide member connected to the float, wherein the conduit extends through the guide member to enter the handle.

7. The concrete float sprayer system of claim 1, wherein the handle is hingedly connected to the float.

8. A concrete float sprayer system, comprising:

a float for smoothing a curing material, the curing material comprising concrete;

a plurality of sprayers on the float, wherein each of the sprayers is adapted to spray a fluid from the float to treat the curing material;

a handle connected to the float;

wherein the float comprises an inner end facing toward the handle and an outer end facing away from the handle, wherein the plurality of sprayers is oriented to spray outwardly from the outer end of the float, wherein the float comprises a right side and a left side, wherein the right side is separated from the left side by the handle, wherein the plurality of sprayers are positioned only on the right side or the left side of the float;

a pump connected to a fluid source; and a conduit fluidly connected between the pump and the sprayers, wherein the conduit extends through the handle, wherein the pump is adapted to transfer a fluid from the fluid source through the conduit to be sprayed by the sprayers.

9. The concrete float sprayer system of claim 8, wherein the float comprises an upper surface and a lower surface, wherein the sprayers are adapted to spray the fluid downwardly from the lower surface of the float.

10. The concrete float sprayer system of claim 8, wherein the sprayers are linearly oriented.

11. The concrete float sprayer system of claim 8, wherein the conduit includes a valve for selectively starting or stopping flow of the fluid through the conduit to the sprayers.

12. The concrete float sprayer system of claim 11, wherein the valve is connected to the handle.

13. The concrete float sprayer system of claim 12, comprising a mobile device for activating or deactivating the pump.

14. The concrete float sprayer system of claim 8, comprising a guide member connected to the float, wherein the conduit extends through the guide member to enter the handle.

15. A concrete float sprayer system, comprising:

a float for smoothing a curing concrete, wherein the float comprises an upper surface, a lower surface, an outer end, an inner end, a first side, and a second side;

a handle hingedly connected to a central point along a width of the float, wherein the float comprises a first portion on a first side of the handle and a second portion on a second side of the handle;

a plurality of sprayers on the upper surface of the float, wherein each of the sprayers is adapted to spray a fluid outwardly from the outer end of the float, wherein each of the sprayers is positioned on the first portion of the float;

wherein the float comprises a right side and a left side, wherein the right side is separated from the left side by the handle, wherein the plurality of sprayers are positioned only on the right side or the left side of the float;

a pump connected to a fluid source;

a conduit fluidly connected between the pump and the sprayers, wherein the conduit extends through the handle, wherein the pump is adapted to transfer a fluid from the fluid source through the conduit to be sprayed by the sprayers to treat the curing concrete;

a mobile device for selectively activating or deactivating the pump; and a valve on the handle for selectively starting or stopping flow of the fluid through the conduit to the sprayers.

* * * * *